US012351384B2

(12) United States Patent
Yan

(10) Patent No.: US 12,351,384 B2
(45) Date of Patent: Jul. 8, 2025

(54) ROTARY ACTUATED DISPENSER

(71) Applicant: ELC Management LLC, Melville, NY (US)

(72) Inventor: Jian Yan, Kirkland (CA)

(73) Assignee: ELC Management LLC, Melville, NY (US)

( * ) Notice: Subject to any disclaimer, the term of this patent is extended or adjusted under 35 U.S.C. 154(b) by 279 days.

(21) Appl. No.: 18/323,139

(22) Filed: May 24, 2023

(65) Prior Publication Data

US 2024/0391677 A1 Nov. 28, 2024

(51) Int. Cl.

| | |
|---|---|
| ***B65D 83/764*** | (2025.01) |
| ***A45D 34/04*** | (2006.01) |
| ***B65D 17/00*** | (2006.01) |
| ***B65D 17/28*** | (2006.01) |
| ***B65D 17/52*** | (2006.01) |
| *A45D 34/00* | (2006.01) |

(52) U.S. Cl.

CPC ..... *B65D 83/764* (2025.01); *A45D 34/04* (2013.01); *B65D 17/02* (2013.01); *B65D 17/401* (2018.01); *B65D 17/52* (2018.01); *A45D 2034/005* (2013.01); *B65D 2583/005* (2013.01)

(58) Field of Classification Search

CPC .... B65D 83/764; B65D 17/401; B65D 17/52; B65D 17/02; B65D 2583/005; A45D 2034/005

USPC ..... 401/171, 172, 173, 174, 175

See application file for complete search history.

(56) References Cited

U.S. PATENT DOCUMENTS

| | | | | |
|---|---|---|---|---|
| 1,968,686 | A * | 7/1934 | Janer | A45D 40/04 401/175 |
| 3,420,417 | A | 1/1969 | Kardel | |
| 4,071,300 | A | 1/1978 | Nichols et al. | |
| 5,025,960 | A | 6/1991 | Seager | |
| 6,688,793 | B2 | 2/2004 | Goyet | |
| 7,946,780 | B2 | 5/2011 | Zhang | |
| 8,506,194 | B2 | 8/2013 | Liu | |
| 9,629,438 | B2 | 4/2017 | Bruder | |
| 10,010,154 | B1 | 7/2018 | Zhang | |
| 2005/0111901 | A1 | 5/2005 | Tintore Belil | |

(Continued)

FOREIGN PATENT DOCUMENTS

| | | | |
|---|---|---|---|
| KR | 10-20040094511 | A | 11/2004 |
| KR | 10-1383079 | B1 | 4/2014 |

OTHER PUBLICATIONS

PCT International Search Report; International Application No. PCT/US2024/029334; Completion Date: Sep. 10, 2024; Mailing Date: Sep. 10, 2024.

(Continued)

*Primary Examiner* — David P Angwin
*Assistant Examiner* — Christopher S. Parisi
(74) *Attorney, Agent, or Firm* — Peter Giancana

(57) ABSTRACT

A handheld rotary actuated product dispenser having a product compartment with a screw-threaded interior wall; a piston with screw threads on the outer circumference of the piston which cooperate with the screw threads of the product compartment; a spindle of non-circular cross section that passes through the center of the piston; and a base member which facilitates rotation of the drive shaft to move the piston within the product compartment so as to dispense product from the product compartment.

8 Claims, 14 Drawing Sheets

(56) References Cited

U.S. PATENT DOCUMENTS

| | | | |
|---|---|---|---|
| 2012/0205393 | A1 | 8/2012 | Perez |
| 2012/0251220 | A1 | 10/2012 | Byun |
| 2021/0362936 | A1 | 11/2021 | Leslie |

OTHER PUBLICATIONS

PCT Written Opinion of the International Searching Authority; International Application No. PCT/US2024/029334; Completion Date: Sep. 10, 2024.

* cited by examiner

ROTARY ACTUATED DISPENSER

FIELD OF THE INVENTION

The invention is in the field of handheld liquid product dispensers. More specifically, the invention pertains to product dispensers with a piston and rotating parts that drive the piston to force product out of the dispenser.

BACKGROUND OF THE INVENTION

Handheld rotary actuated dispensers are known. In one common design, a product container comprises a piston that has a central aperture. The central aperture is formed as a screw thread. This thread cooperates with a screw thread located on a drive shaft that extends through the height of the container. As the drive shaft rotates relative to the piston, the piston advances along the drive shaft and urges a flowable product toward an exit orifice of the container. In this arrangement, both the drive shaft and aperture of the piston must be circular. Designs of this type have drawbacks. For example, the drive shaft and piston must be assembled into the product container before filling, but the drive shaft, which extends substantially through the length of the product container, gets in the way of a typical filling nozzle which normally extends down into the container during filling. Attempts have been made to alleviate this problem by bottom filling the product container, and then inserting the drive shaft and piston into the container. However, new problems are created by the tendency to entrap air in the product, and the need to release excess pressure. There remains a need for a rotary actuated product dispenser that utilizes a screw-driven piston while avoiding the drawbacks of conventional rotary actuated dispensers.

OBJECT OF THE INVENTION

One object of the invention is to provide a rotary actuated product dispenser with reusable parts.

Another object of the invention is to provide a rotary actuated product dispenser that utilize a screw-driven piston, and that features a replaceable product cartridge with integrated tamper-evident design.

Another object of the invention is to provide a rotary actuated product dispenser that avoids the entrapment of air and excess pressure during filling and assembly.

SUMMARY OF THE INVENTION

The objectives of the invention are met by a rotary actuated product dispenser that comprises a base member, an overcap and a replaceable cartridge. The replaceable cartridge comprises a container that houses a product reservoir, a piston, a drive shaft, a first applicator tip, and an optional secondary applicator tip. The container comprises an interior wall of circular cross section that is fashioned with a screw thread that extends from the bottom toward the top of the reservoir. A circular piston is located in the product reservoir, and has a screw thread on its outer circumference designed to cooperate with the screw thread of the reservoir. A non-threaded drive shaft of non-circular cross section passes through a similarly shaped aperture in the center of the piston. The first applicator tip is attached to the top of the product reservoir. The optional secondary applicator tip fits over the first applicator tip. The base member facilitates rotation of the drive shaft to move the piston within the product reservoir so as to dispense product onto an exterior surface of the dispenser.

DETAILED DESCRIPTION

Figure 1:
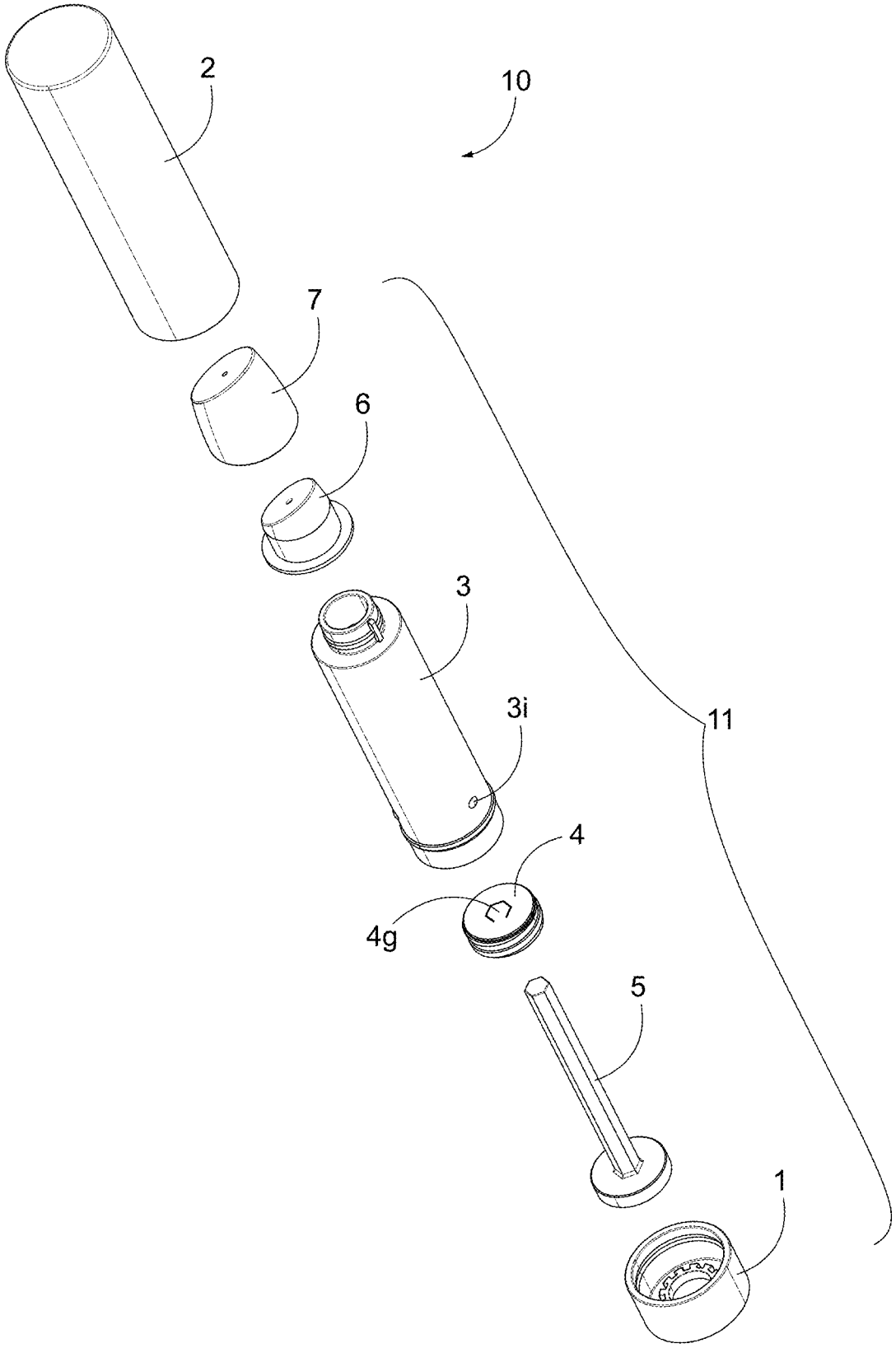
FIG. 1 is an exploded view of a handheld rotary actuated product dispenser according to the present invention.

Throughout this specification, the term "comprise" means that a collection of objects is not limited to those objects specifically recited.

Throughout this specification "flowable" means that, if allowed, a product is capable of deforming in response to its own weight.

Throughout the specification "personal care product" means any topical preparation that provides a benefit to the surface to which it is applied or provides a benefit to the subject to which it is applied. "Personal care product" includes cosmetic, dermatological, pharmaceutical, and nutraceutical preparations, as well as things like food products and adhesives, Referring to FIG. 1, a handheld rotary actuated product dispenser (10) according to the present invention comprises reusable components and a disposable replaceable cartridge. The reusable components include a base member (1) and an overcap (2). The replaceable cartridge (11) comprises a container (3) for housing a flowable product, a piston (4), a drive shaft (5), a first applicator tip (6) and an optional secondary applicator tip (7). The product dispenser is intended to house and deliver a flowable product, especially a cosmetic or personal care product. Preferably, the flowable product is virtually incompressible.

The Base Member

Figure 2:
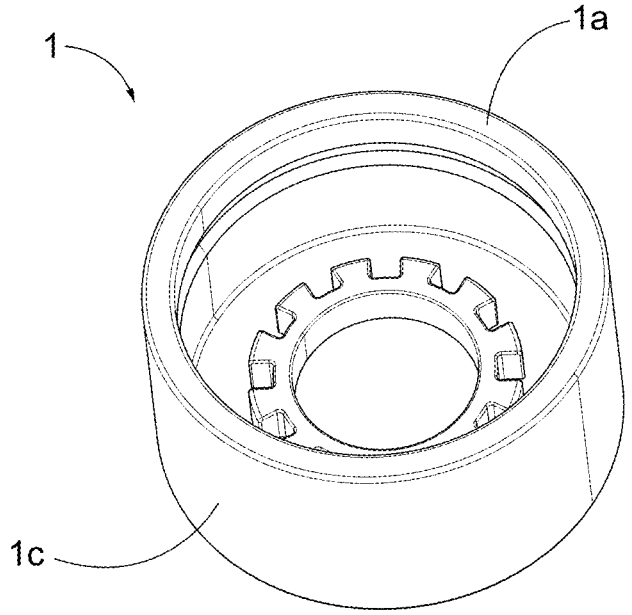
FIG. 2 is a perspective view of a base member used in the present invention.
Figure 3:
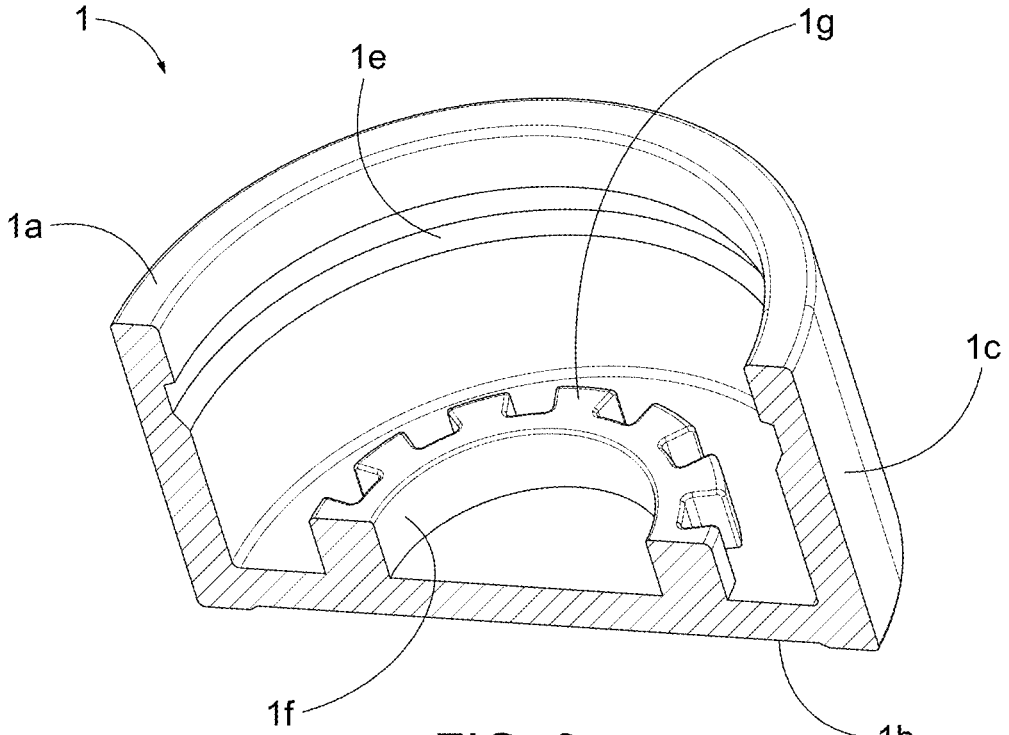
FIG. 3 is a cross sectional perspective view of a base member used in the present invention.

Referring to FIGS. 2 and 3, a preferred embodiment of the base member (1) comprises a cylindrical wall (1*c*) that has an opened top (1*a*) and a closed bottom (1*b*). The cylindrical wall and closed bottom each have an inner surface. The inner surface of the cylindrical wall is formed with an annular groove (1*e*). A circular gear (1*f*) sits on the inner surface of the closed bottom (1*b*) of the base member. The circular gear comprises a plurality of equally spaced teeth (1*g*).

The Container

Figure 4:
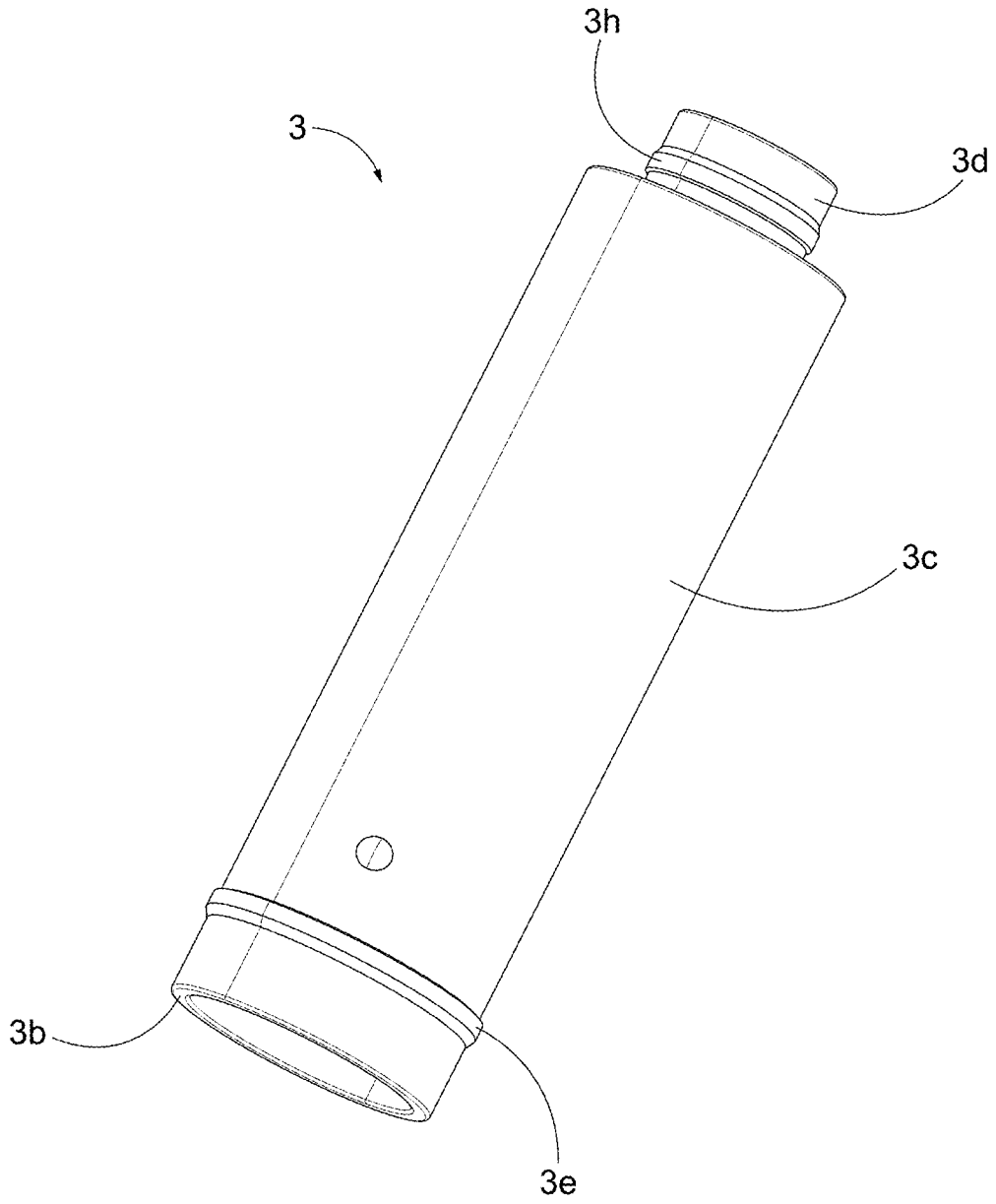
FIG. 4 is a perspective view of a product container used in the present invention.
Figure 5:
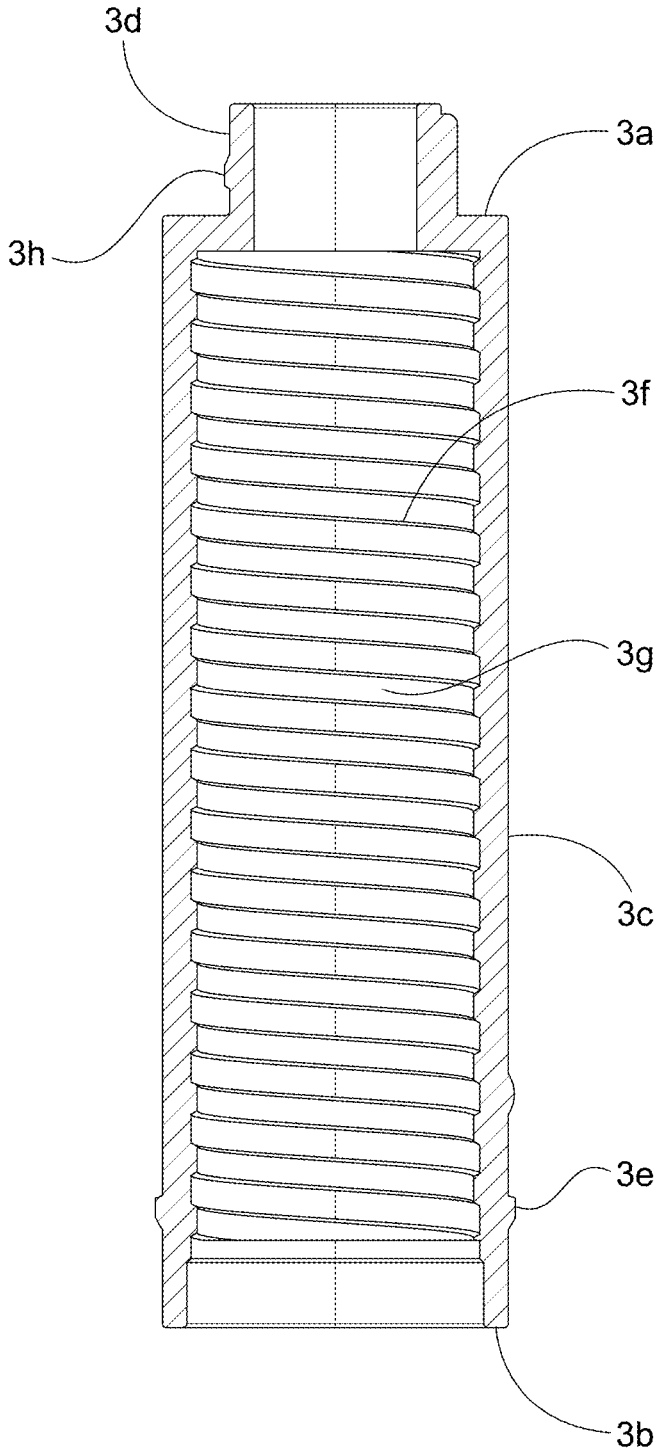
FIG. 5 is a cross sectional view of the product container of FIG. 4.

One embodiment of a container (3), shown in FIGS. 4 and 5, defines a reservoir (3*g*) for receiving and housing a flowable product (P). The reservoir may typically be sized to house from up to 1000 mL of flowable product. The container has a cylindrical side wall (3*c*), an opened bottom (3*b*), and a top (3*a*) that supports the neck (3*d*) of the container. The bottom (3*b*) of the container is sized to fit inside the cylindrical wall (1*c*) of the base member (1), such that a raised bead (3*e*) on the side wall (3*c*) rests inside the annular groove (1*e*) of the base member. The raised bead (3*e*) and annular groove (1*e*) cooperate to retain the container (3) in the base member, while allowing relative rotation between the two members. The interior surface of the side wall (3*c*) of the container is formed as a spiral thread (3*f*) that extends between the top and bottom of the product reservoir. Preferably, the spiral thread (3*f*) does not extend all the way to the bottom (3*b*) of the container in order to accommodate the drive shaft (see below). The neck of the container may comprise a circumferential bead (3*h*).

The Drive Shaft

Figure 6:
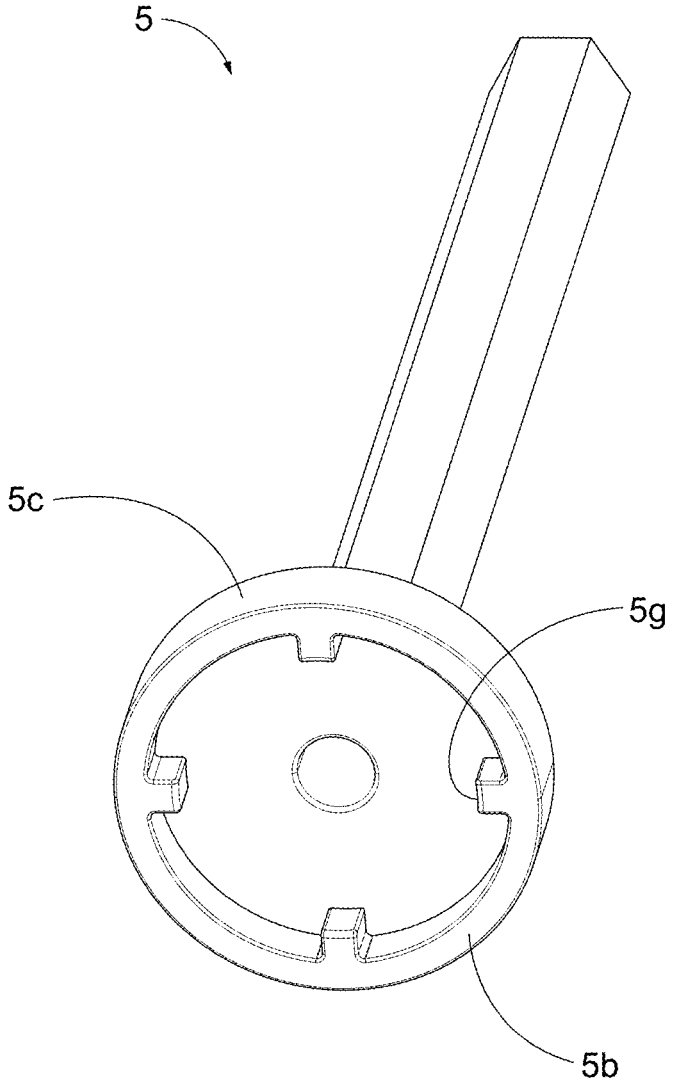
FIG. 6 is a perspective view of a drive shaft according to the present invention.
Figure 7:
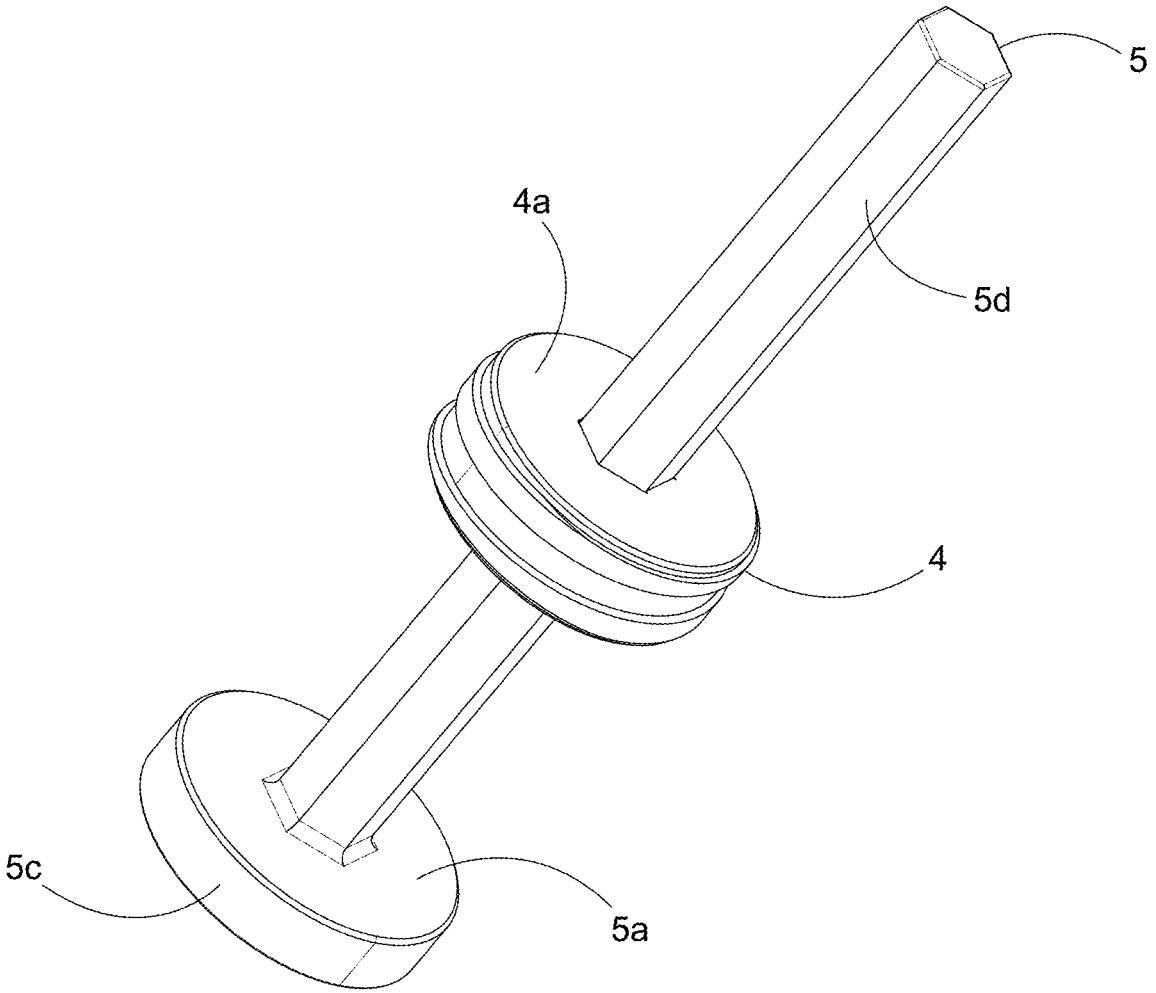
FIG. 7 depicts a piston located on the spindle of the drive shaft of FIG. 6.

One embodiment of the drive shaft (5) is shown in FIGS. 6 and 7. The drive shaft comprises a cylindrical member (5*c*) that is positioned in the opened bottom (3*b*) of the container (3) just below the spiral thread (3*f*) of the container. The cylindrical member has a closed top (5*a*) and an opened bottom (5*b*); together, these define the interior of the cylindrical member. On the interior of the cylindrical member are two or more teeth (5*g*). Extending from the top (5*a*) of the cylindrical member is a spindle (5*d*) that extends toward the top (3*a*) of the container (3). As shown in FIG. 7, the cross section of the spindle is a regular hexagon. However, in general, the cross section of the spindle only need be non-circular. It is important to note that the spindle (5*d*) does not have screw threads, as is commonly done.

The Piston

Figure 9:
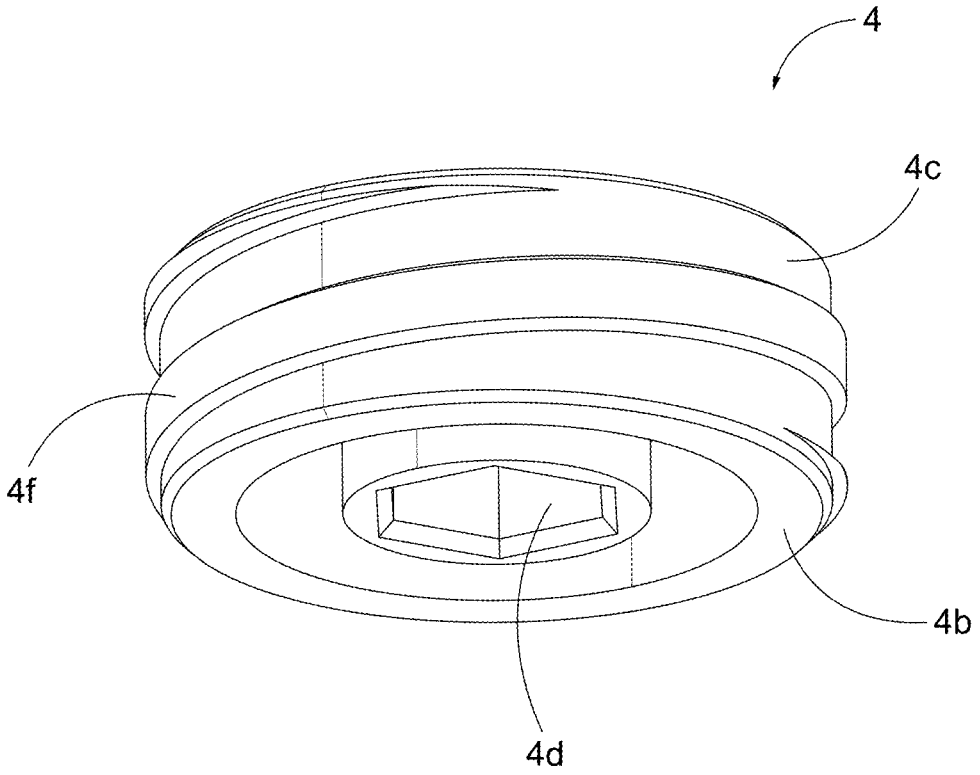
FIG. 9 is a perspective view of a piston used in the present invention.

One embodiment of a piston is shown in FIGS. 1 and 9. The piston (4) is located in the container (3). The piston comprises a cylindrical side wall (4*c*), a top (4*a*) (initially closed) and an opened bottom (4*b*). A channel (4*d*) passes through the top of the piston. The channel (4*d*) is designed to receive the spindle (5*d*) of the drive shaft (FIG. 7). The channel has the same non-circular cross sectional shape as the spindle, so that, as the spindle rotates, so must the piston. The channel and the spindle are sized to maintain a certain tight interference. The cross section of the channel is only slightly smaller than the cross section of the spindle, to allow the piston to slide up and down along the spindle while maintaining contact with the spindle. The contact is sufficient to form an effective fluid seal between the piston (4) and spindle (5*d*), and may also be sufficient to hold the spindle in the piston so that the piston does not back out under its own weight.

Initially, prior to inserting the spindle (5*d*) of the drive shaft (5) through the piston (4), the channel (4*d*) of he piston is closed at the top (4*a*) by a fluid tight seal. For example, at the top (4*a*) of the piston, the channel may be closed by a frangible section (4*g*). Initially, the frangible section forms a fluid tight seal that prevents product from entering the channel. Later, the frangible section (4*g*) may be easily pushed through by the spindle (5*d*) of the drive shaft (5). For example, the frangible section may be an integrally molded section that is relatively thinner than the surrounding area, along its perimeter. Or, if the piston is molded such that the channel (4*d*) passes completely through the top of the piston, then the frangible section may be a sealing membrane, such as a paper or foil label, that is secured with adhesive across the channel at the top of the piston. Either way, the frangible section is easily broken when the spindle (5*d*) of the drive shaft (5) is inserted through the channel (4*d*) of the piston (4). In one preferred embodiment, the frangible section is an integrally molded section that is relatively thinner than the surrounding area, along its perimeter, except for one straight portion. For example, if the channel and frangible section are hexagonal, than one side of the hexagonal frangible section is relatively thicker than the other five sides. With this design, when the spindle (5*d*) is pushed through the frangible section (4*d*), one edge of the frangible section remains attached to the piston, so that it does not float freely in the product reservoir (3*g*).

The side wall (4*c*) of the piston (4) supports a spiral thread (4*f*) on its outer circumference. Preferably, the spiral thread wraps around the piston at least one full rotation, more preferably, at least one and half rotations. The spiral thread (4*f*) of the piston (4) is designed to engage the spiral thread (3*f*) on the interior surface of the side wall (3*c*) of the container (3). A sufficiently tight tolerance should be maintained between the side wall (4*c*) of the piston and the interior surface of the side wall (3*c*) of the container (3), such that little or no product in the reservoir (3*g*) is able to seep below the piston.

Figure 8:
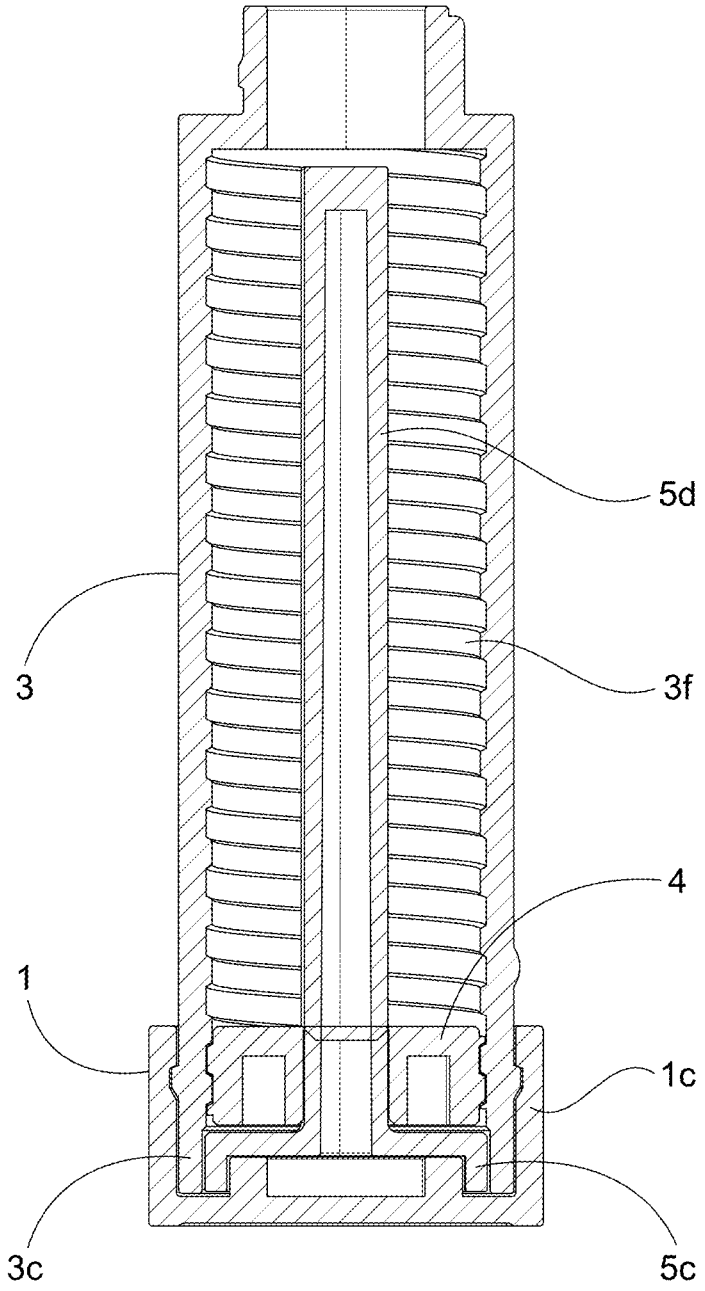
FIG. 8 shows the assembly of the base member, container and drive shaft.

The piston (4), drive shaft (5), container (3) and base member (1) are sized to nest inside each other, as follows. The piston is threaded onto the spiral thread (3*f*) of the container near the bottom of the product reservoir (3*g*). The spindle (5*d*) of the drive shaft (5) passes through the channel (4*d*) of the piston, while the cylindrical member (5*c*) of the drive shaft rests inside the cylindrical wall (3*c*) of the container just below the level of the spiral thread (3*f*). Also, the bottom (3*b*) of the container rests inside the cylindrical wall (1*c*) of the base member, such that the teeth (5*g*) of the drive shaft rest between the teeth (1*g*) of the base member (1). In this configuration (see FIG. 8), when a relative rotation is effected between the base member (1) and the container (3), then the spindle (5*d*) rotates within the reservoir (3*g*), which causes the piston (4) to rotate. At the same time, the thread engagement between the piston and the side wall of the container causes the piston to slide along the spindle, either up or down, depending on the direction of the relative rotation. As the piston advances upward, it pushes product in the reservoir (3*g*) toward the neck (3*d*) of the container (3).

Applicator Tips

Figure 10:
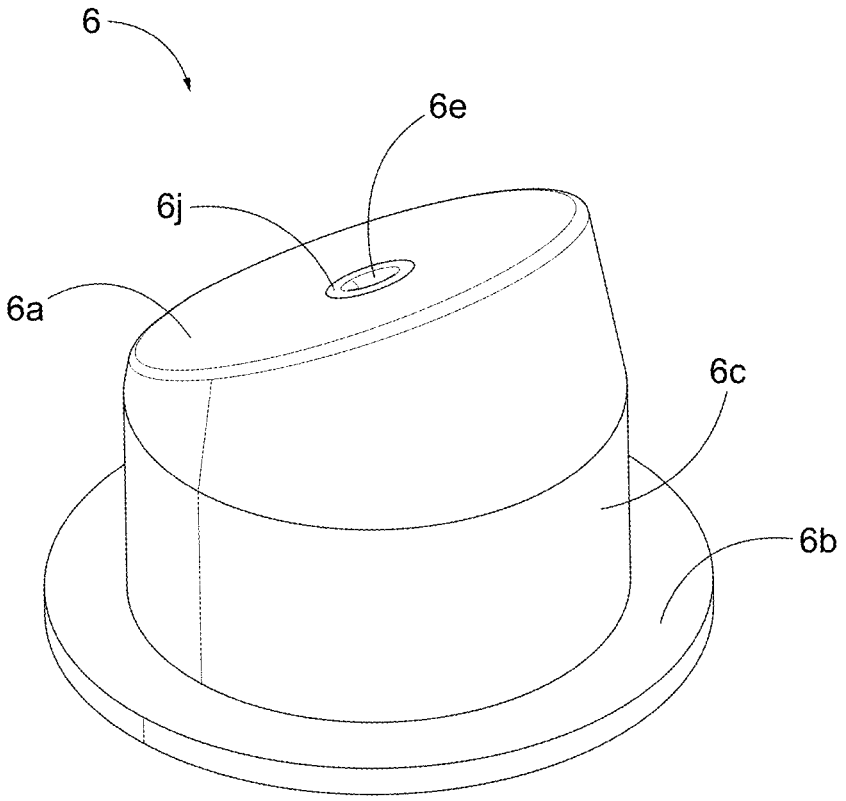
FIGS. 10 and 11 depict one embodiment of a first applicator tip.
Figure 11:
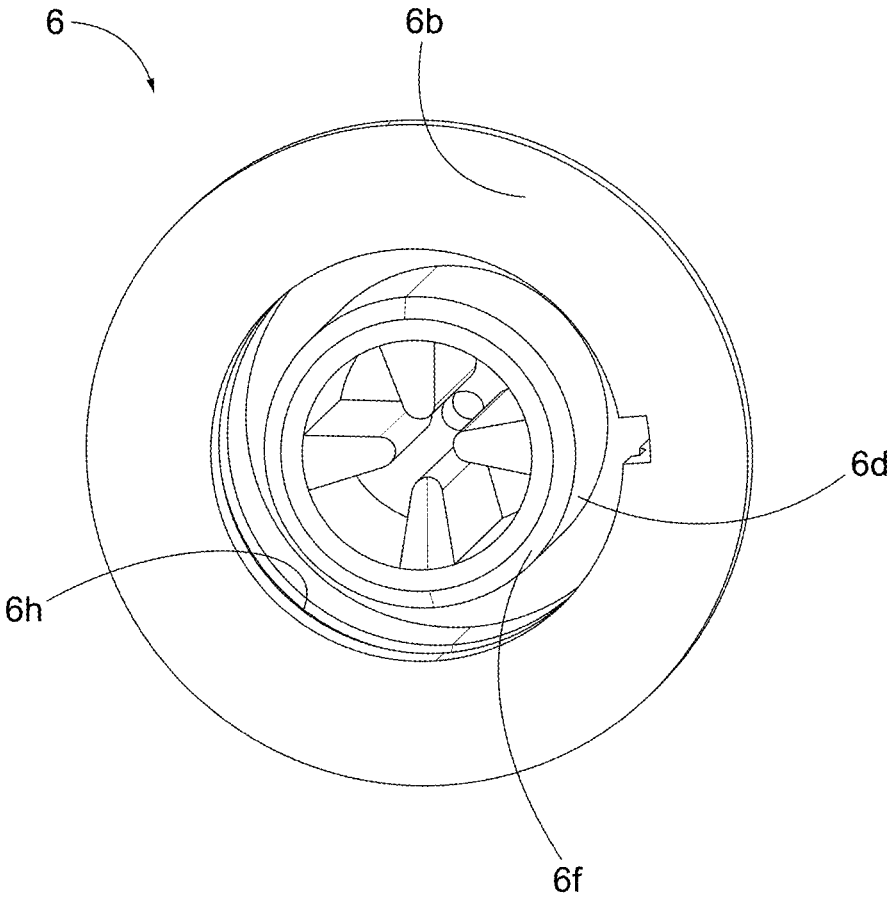

The neck (3*d*) of the container (3) is fitted with a first applicator tip (6). In one embodiment, shown in FIGS. 10-12, the first applicator tip comprises a top surface (6*a*), an opened bottom (6*b*) formed as a circular flange that extends radially outward from the sidewall, and a sidewall (6*c*) that makes a secure engagement around the outside of the neck (3*d*). A first channel (6*d*) depends below the top surface (6*a*), into the interior of the first applicator tip. The top end of the first channel is formed as a first exit orifice (6*e*) that opens up onto the top surface of the first applicator tip. The bottom (6*f*) of the first channel is cylindrical, and sized to fit snuggly into the neck (3*d*) of the container (3) so as to form a fluid tight seal. In order to prevent deformation of the first channel, or otherwise maintain the integrity of the first channel, the first applicator tip should be made of relatively rigid plastic, and yet be sufficiently soft to maintain airtightness with the neck (3*d*) of the container (3). The first applicator tip may be secured to the neck by any suitable means, so that the first applicator tip will not inadvertently come apart in normal use of the dispenser (10). For example, cooperating screw threads may be used. Alternatively, the figures show a circumferential bead (3*h*) of the neck (3*d*) that is positioned to rest in an annular groove (6*h*) of the first applicator tip.

When the first applicator tip is secured to the neck of the container, then a flow path is created from within the reservoir (3*g*) to an exterior surface of the first applicator tip. As product emerges from the first exit orifice (6*e*), it accumulates on the top surface (6*a*), from where it can be applied to target surface, such as skin or hair.

Optionally, the first exit orifice (6*e*) may be covered with a sealing membrane (6*j*) that protects the contents of the reservoir (3*g*). The sealing membrane, such as a plastic, paper or foil label, may be affixed with removeable adhesive, and discarded before first use.

Optionally, a secondary applicator tip (7) may be fitted over the first applicator tip (6). The secondary applicator tip may be selected to provide a particular sensory experience to a user. For example, all or some portion of the secondary applicator tip may be softer than the first applicator tip, spongy, flocked, mildly abrasive or any texture that provides a certain sensory experience to a user. Preferably, the secondary applicator tip (7) makes an interference fit with the first applicator tip (6) that will not come loose during use, but which can be intentionally removed by a user, and replaced with a different secondary applicator tip, as desired.

Figure 12:
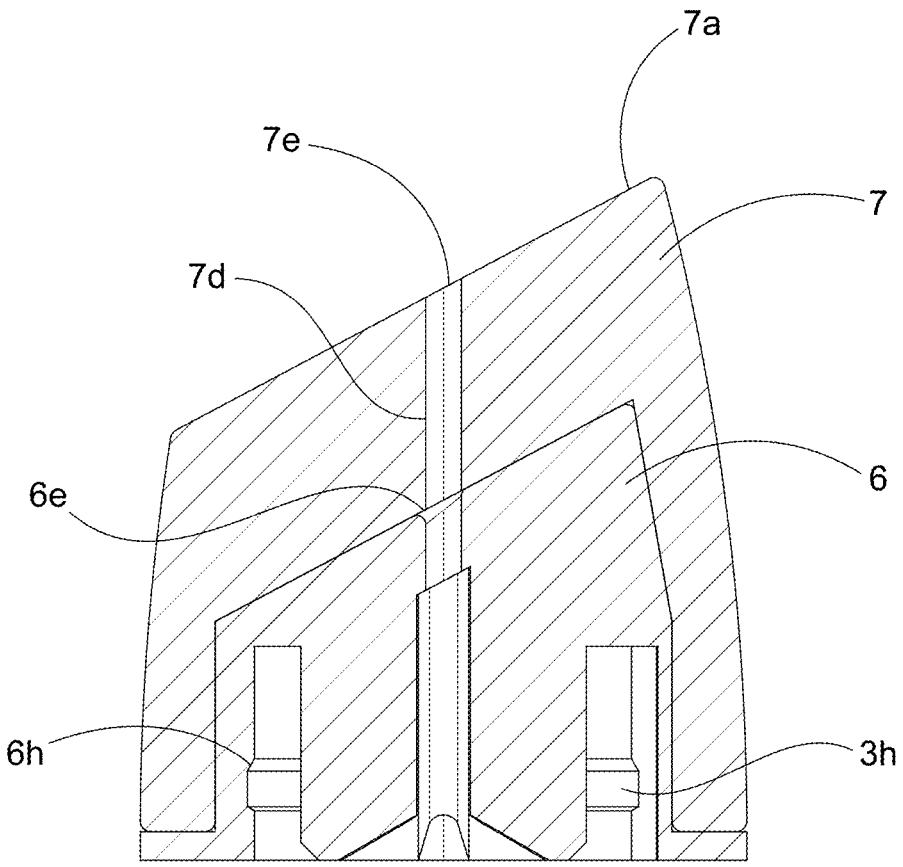
FIG. 12 is a cross sectional view of a secondary applicator tip mounted on a first applicator tip.

One example of a secondary applicator tip (7) is shown in FIG. 12. In that embodiment, the secondary applicator tip comprises a secondary channel (7*d*) that aligns with the first channel (6*d*) of the first applicator tip (6) to extend the product flow path to a secondary exit orifice (7*e*) that opens up onto an exterior surface (7*a*) of the secondary applicator tip. The exterior surface of the secondary applicator tip may be implemented as a sponge, flocking, exfoliating abrasive or any texture that provides a certain sensory experience to a user. As product emerges from the secondary exit orifice (7*e*), it accumulates on or within the exterior surface (7*a*) of the secondary applicator tip. For example, as product emerges from the secondary exit orifice (7*e*), the product infuses the spaces in a sponge or flocking.

The Overcap

Figure 13:
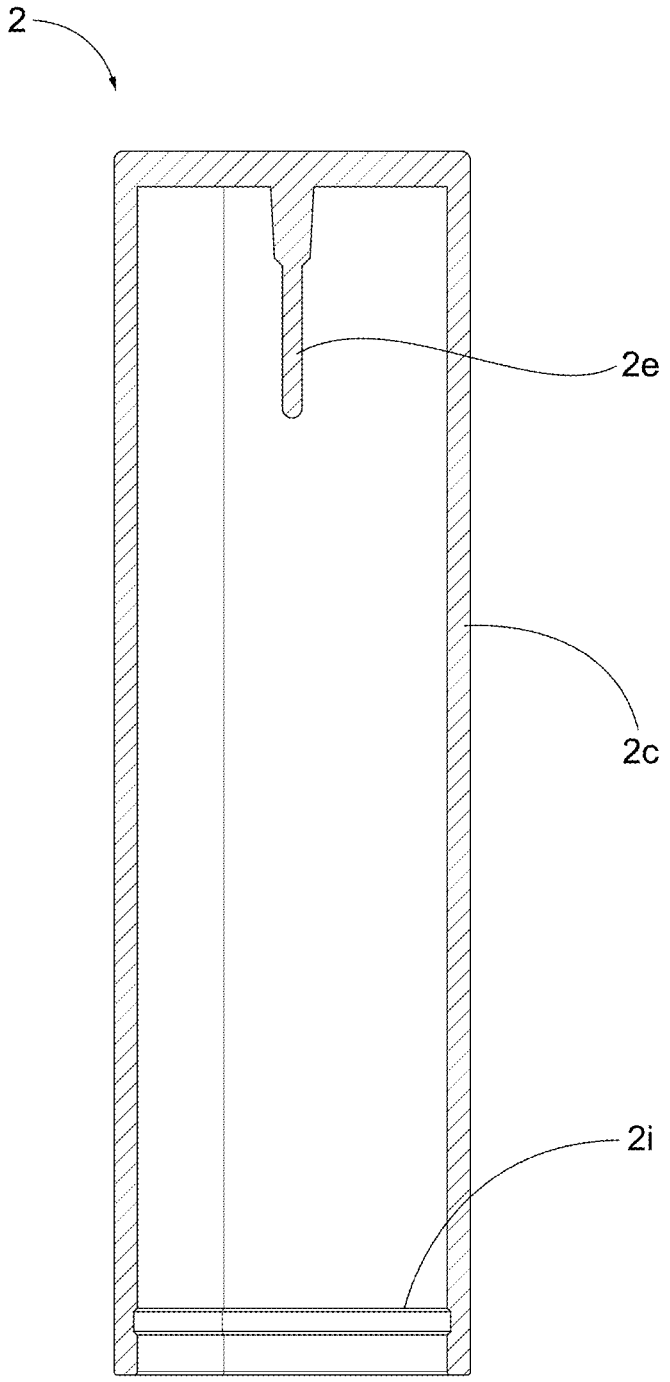
FIG. 13 is a cross sectional view of an overcap.

An overcap (2) may be used to protect the first and secondary applicator tips (6, 7) of the dispenser (10), and to give the dispenser a finished appearance. For example, a generally cylindrical overcap (2) may be fitted over the first and secondary applicator tips. Preferably, the overcap and container (3) form an interference fit. To facilitate this, two or more raised bumps (3*i*) may be located on the sidewall (3*c*) of the container, or a circular retaining bead (2*i*) may be located on the interior of the sidewall (2*c*) of the overcap (2), or both. As shown in FIG. 13, a pintel (2*e*) may depend from the underside of the overcap, which is designed to enter the channel (6*d*) of the first applicator tip (6), to seal the channel (6*d*) when the product dispense is not in use.

Assembly and Filling Procedure

The following steps demonstrate one preferred filling procedure.

a. The piston (4), with frangible section (4*g*) in tact, is inserted into the opened bottom (3*b*) of the product container (3), and threaded onto the spiral thread (3*f*) of the container, near the bottom of the product reservoir (3*g*).
b. The product reservoir (3*g*) is filled through the neck (3*d*) of the container (3). Note, there is no obstruction of the filling nozzle.
c. The spindle (5*d*) of the drive shaft (5) is inserted through the channel (4*d*) of the piston (4), breaking the frangible section (4*g*). The cylindrical member (5*c*) of the drive shaft comes to rest inside the cylindrical wall (3*c*) of the container just below the level of the spiral thread (3*f*). Note, there is no excess pressure to be relieved.
d. The base member (1) is then fitted onto the container (3) such that the raised bead (3*e*) of the container rests inside the annular groove (1*e*) of the base member, at which time the teeth (5*g*) of the drive shaft rest between teeth (1*g*) of the base member.
e. The first applicator tip (6), with or without the optional secondary applicator tip (7), is attached to the neck (3*d*) of the container.
f. The overcap (2) is secured to the container.

Variations of this assembly and filling sequence are possible.

Replacement Cartridge Assembly and Filling Procedure

Figure 14:
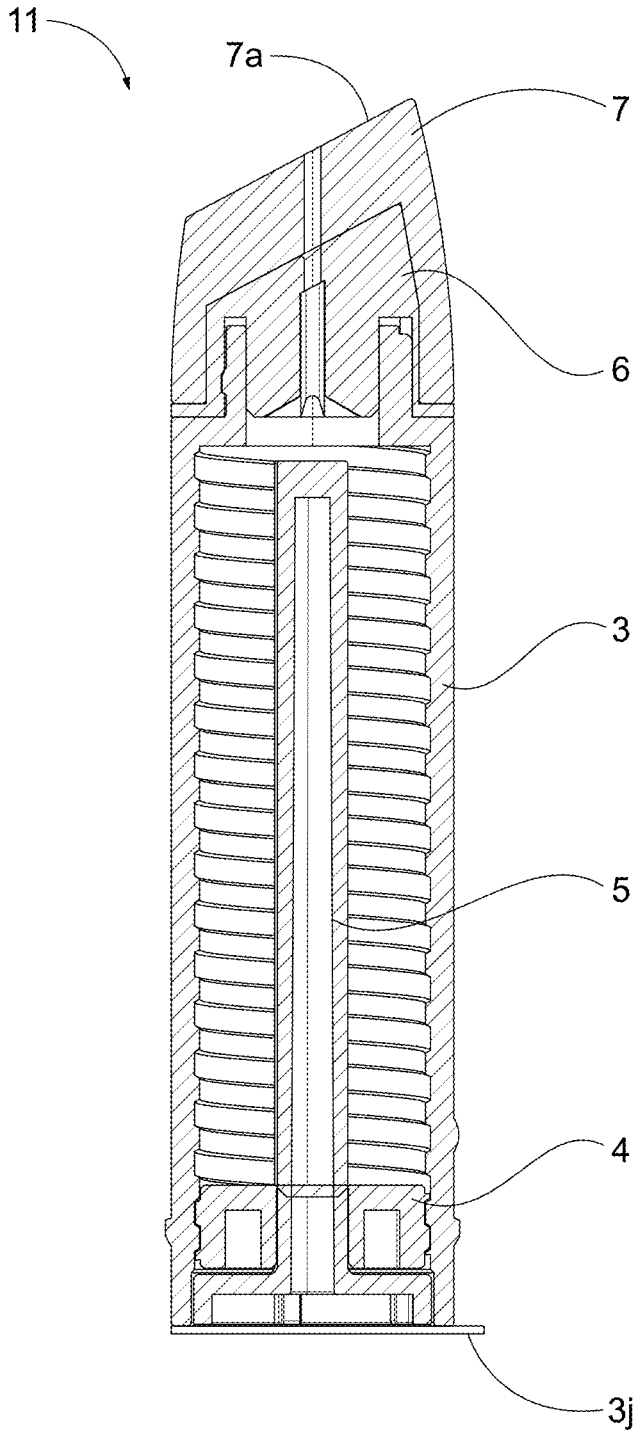
FIG. 14 is a cross sectional view of a replaceable cartridge for use in a handheld rotary actuated product dispenser according to the present invention.

As described above, the container (3), piston (4), drive shaft (5), first applicator tip (6) and optional secondary applicator tip (7) together, constitute a replaceable cartridge (FIG. 14). Once the product is exhausted from the reservoir (3*g*) of the container (3), the cartridge may easily be separated from the base member (1) and overcap (2). The base member and overcap may be reused with a fresh replacement cartridge. The assembly and filling procedure of a replacement cartridge is slightly different from the procedure described above.

a. The piston (4), with frangible section (4*g*) intact, is inserted into the opened bottom (3*b*) of the product container (3), and threaded onto the spiral thread (3*f*) of the container, near the bottom of the product reservoir (3*g*).
b. The product reservoir (3*g*) is filled through the neck (3*d*) of the container (3).
c. The first applicator tip (6), having the first exit orifice (6*e*) covered by a removeable sealing membrane, is attached to the neck (3*d*) of the container.

At this point, product is completely sealed in the container, and the container (3) with product, the piston (4), and the first applicator tip (6) constitute a subassembly of the replaceable product cartridge. The drive shaft (5) may be immediately joined to the subassembly, or at some later time and place. Until then, the intact frangible section (4*g*) of the piston (4) acts as a tamper evident feature that indicates whether the product in the container has been disturbed since being filled.

d. At an appropriate time, the spindle (5*d*) of the drive shaft (5) is inserted through the channel (4*d*) of the piston (4), breaking the frangible section (4*g*). The cylindrical member (5*c*) of the drive shaft comes to rest inside the cylindrical wall (3*c*) of the container just below the level of the spiral thread (3*f*).
e. As noted above, the contact between the piston (4) and spindle (5*d*) may be sufficient to hold the spindle in the piston so that the piston does not back out of the piston under its own weight. However, optionally, the bottom (3*b*) of the product container (3) may be sealed with a removable membrane (3*j*), such as a paper or foil label secured with removable adhesive.

At this point, a complete replacement cartridge has been assembled. When it is time to use the replacement cartridge, the removable membrane (3*j*) is removed, and the replacement cartridge is inserted into the base member (1), and the overcap (2) is applied. Preferably, the base member and overcap are implemented as an upscale luxury item or keepsake. The exterior surfaces of the base member and overcap may receive any type of decoration or ornate treatment that convey a sense of luxury or that might transform the dispenser into a collector's item.

Use

Figure 15:
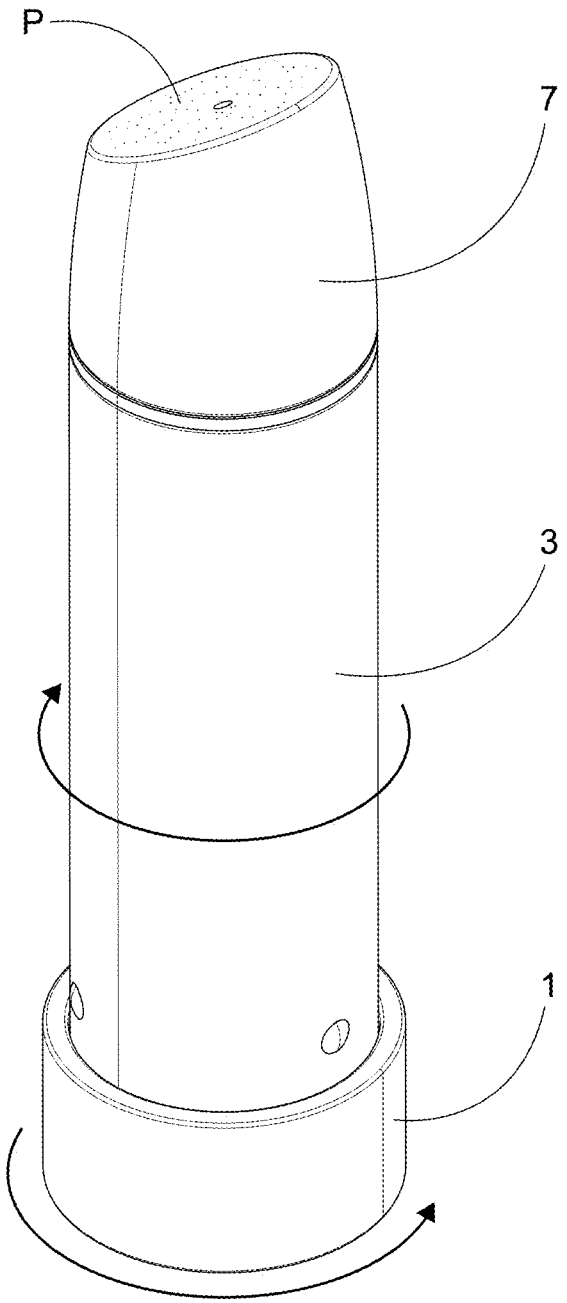
FIG. 15 depicts the use of a handheld rotary actuated product dispenser according to the present invention

In the fully assembled handheld dispenser (10) described herein, a user grasps the base member (1) in one hand, and the container (3) in the other hand. When a relative rotation is effected between the base member (1) and the container (3) (FIG. 15), then the spindle (5*d*) rotates within the reservoir (3*g*), which causes the piston (4) to rotate. At the same time, the thread engagement causes the piston to slide along the spindle, either up or down, depending on the direction of the relative rotation. As the piston advances upward, it pushes product (P) in the reservoir (3*g*) through the neck (3*d*) of the container (3), through the first channel (6*d*) of the first applicator tip (6), to emerge onto the top surface (6*a*). Or, if an optional secondary applicator tip (7) is present, the product will pass through the secondary channel (7*d*) to accumulate on or within the exterior surface (7*a*) of the secondary applicator tip. For example, the product may infuse the spaces in a sponge or flocking. The first or secondary applicator tip (as the case may be) may then be drawn across a target surface, such as skin or hair, to transfer product (P) to the target surface.

What is claimed is:

1. A handheld rotary actuated product dispenser (10) that comprises a base member (1) and a replaceable cartridge (11), wherein:

the base member (1) comprises:

a cylindrical wall (1*c*) with an inner surface;

an opened top (1*a*);

a closed bottom (1*b*) with an inner surface;

a circular gear (1*f*) that sits on the inner surface of the closed bottom (1*b*), and comprises a plurality teeth (1*g*);

the replaceable cartridge (11) comprises:

a container (3) that has:

a top (3*a*) that supports a neck (3*d*), an opened bottom (3*b*) and a side wall (3*c*) that define a reservoir (3*g*) for housing a flowable product, wherein the side wall has an interior surface that is formed as a spiral thread (3*f*) that extends between the top and closed bottom of the container (3);

a piston (4) located in the container (3), and having:

a top (4*a*), an opened bottom (4*b*), and a side wall (4*c*) that has a spiral thread (4*f*) on its outer circumference, such that the spiral thread of the piston engages the spiral thread (3*f*) of the container (3); and a channel (4*d*) of non-circular cross section that passes through the top (4*a*) of the piston (4);

a non-threaded drive shaft (5) comprising:

a cylindrical member (5*c*) positioned in the opened bottom (3*b*) of the container (3), the cylindrical member having a closed top (5*a*) and an opened bottom (5*b*);

two or more teeth (5*g*) located on the interior of the cylindrical member (5*c*);

a spindle (5*d*) of non-circular cross section that extends from the top (5*a*) of the cylindrical member (5*c*), and passes through the channel (4*d*) of the piston (4); and a first applicator tip (6) attached to the top of the container (3) and comprising:

a top (6*a*), a sidewall (6*c*) and an opened bottom (6*b*) that define an interior of the first applicator tip (6);

a channel (6*d*) that depends from the top (6*a*) into the interior of the first applicator tip, wherein one end of the channel fits snuggly into the neck (3*d*) of the container (3); and the other end is formed as an exit orifice (6*e*); and wherein the bottom (3*b*) of the container (3) is fitted within the cylindrical wall (1*c*) of the base member (1), such that the two or more teeth (5*g*) of the drive shaft rest between teeth (1*g*) of the base member, and the base member and non-threaded drive shaft (5) are able to rotate as one relative to the container (3).

2. A handheld rotary actuated product dispenser according to claim 1, wherein a relative rotation between the base member (1) and the container (3) causes the piston (4) to slide along the spindle (5*d*), either up or down, depending on the direction of the relative rotation.

3. A handheld rotary actuated product dispenser according to claim 1, further comprising a secondary applicator tip (7) that is fitted over the first applicator tip (6), and that comprises an exterior surface (7*a*) that is spongy, flocked or abrasive.

4. A handheld rotary actuated product dispenser according to claim 1, wherein the channel (4*d*) of the piston (4) is initially closed by a frangible section (4*g*) that is broken when the spindle (5*d*) of the drive shaft (5) is inserted through the channel (4*d*).

5. A handheld rotary actuated product dispenser according to claim 1, further comprising an overcap (2) that covers the first applicator tip (6).

6. A handheld rotary actuated product dispenser according to claim 1, wherein the reservoir is sized to house up to 1000 mL of flowable product.

7. A method of assembling and filling a handheld rotary actuated product dispenser according to claim 1 comprising the steps of:

a. inserting the piston (4), with the frangible section (4*g*) in tact, into the opened bottom (3*b*) of the product container (3), and threading the piston onto the spiral thread (3*f*) of the container (3), near the bottom of the product reservoir (3*g*);

b. filling the product reservoir (3*g*) through the neck (3*d*) of the container (3);

c. inserting the spindle (5*d*) of the drive shaft (5) through the channel (4*d*) of the piston (4), breaking the frangible section (4*g*);

d. fitting the base member (1) onto the container (3) such that the teeth (5*g*) of the drive shaft rest between teeth (1*g*) of the base member; and e. attaching the first applicator tip (6), with or without the optional secondary applicator tip (7), to the neck (3*d*) of the container (3).

8. A method of assembling and filling a replacement cartridge for a handheld rotary actuated product dispenser according to claim 1 comprising the steps of:

a. inserting the piston (4), with the frangible section (4*g*) in tact, into the opened bottom (3*b*) of the product container (3), and threading the piston onto the spiral thread (3*f*) of the container (3), near the bottom of the product reservoir (3*g*);

b. filling the product reservoir (3*g*) through the neck (3*d*) of the container (3);

c. attaching the first applicator tip (6), to the neck (3*d*) of the container (3);

d. inserting the spindle (5*d*) of the drive shaft (5) through the channel (4*d*) of the piston (4), breaking the frangible section (4*g*); and e. optionally, the bottom (3*b*) of the product container (3) is sealed with a removable membrane (3*j*).

* * * * *